US005660005A

United States Patent [19]

Tacoma

[11] Patent Number: 5,660,005

[45] Date of Patent: Aug. 26, 1997

[54] HIGH STRENGTH, LIGHT WEIGHT, PORTABLE BUILDING

[76] Inventor: Michael T. Tacoma, 20241 Japatul Rd., Alpine, Calif. 91901

[21] Appl. No.: 349,738

[22] Filed: Dec. 5, 1994

[51] Int. Cl.[6] ..... E04B 7/04; E04B 1/32

[52] U.S. Cl. ..... 52/93.2; 52/63; 52/222; 52/273; 52/639; 52/641; 52/643; 52/646; 52/653.2

[58] Field of Search ..... 52/93.2, 643, 641, 52/639, 63, 222, 273, 653.2, 732.1, 646; 403/205, 382, 403; 411/546, 383, 384, 535, 536

[56] References Cited

U.S. PATENT DOCUMENTS

| | | | |
|---|---|---|---|
| 1,622,071 | 3/1927 | Urban, Sr. | 52/653.2 X |
| 1,835,243 | 12/1931 | Schaffert | 52/508 X |
| 2,931,129 | 4/1960 | Boniface | 403/403 X |
| 3,100,012 | 8/1963 | Dunn | 52/93.2 X |
| 3,740,084 | 6/1973 | Tellberg | 52/645 X |
| 3,836,270 | 9/1974 | Chambers | 403/205 X |
| 5,193,327 | 3/1993 | Goodenberger | 52/653.2 X |

*Primary Examiner*—Christopher T. Kent
*Attorney, Agent, or Firm*—Gilliam, Duncan & Harms

[57] ABSTRACT

A portable steel framed building which can be rapidly assembled and disassembled. Components of a typical building include at least one ridge beam connected between two spaced ridge receivers with two rafters also secured to the ridge receiver. The rafters extend through hip receivers each of which is connected to a hip beam and a post. Thus, two identical ridge receivers and four identical hip receivers, plus a ridge beam, two hip beams and four posts are sufficient to construct a complete building. With additional identical components, the size of the building may be extended and other configurations, such as valley, shed or gable roofs may be constructed. If desired, purlins may be provided between rafters and crosspieces may be provided between posts. Fascia members may be fastened to the ends of the rafters, and may include a component for holding the ends of a fabric roof covering. The posts may be telescoping to allow building height to be varied or irregular foundations to be accommodated. The ends of the posts may include plates for fastening to a foundation, or may have sufficient length to extend into holes in a surface of concrete or the like. A preferred method of forming the various receivers from sheet metal with high precision is described.

10 Claims, 9 Drawing Sheets

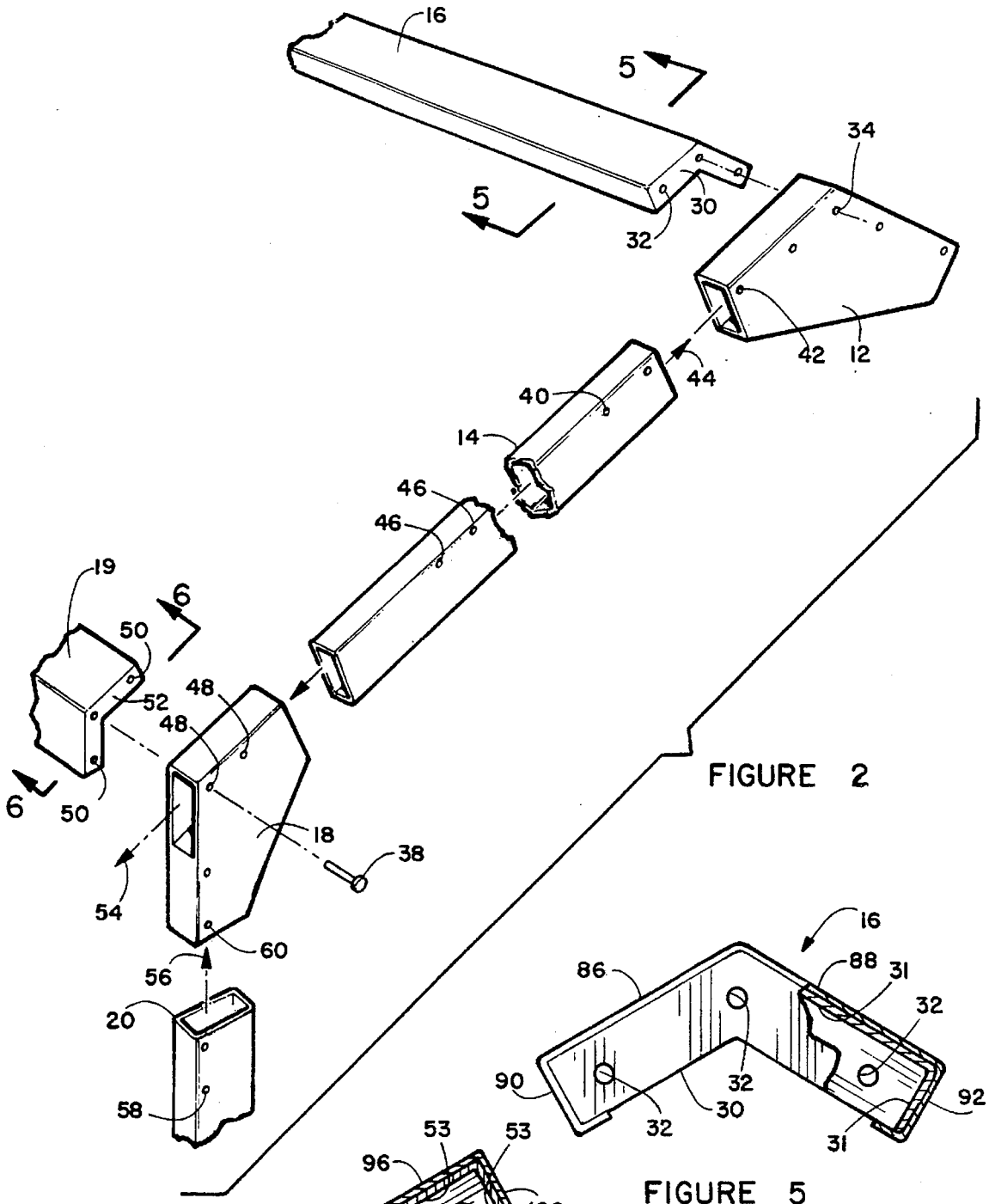
FIGURE 2
FIGURE 5
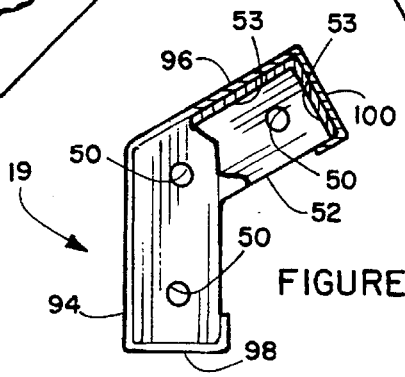
FIGURE 6

HIGH STRENGTH, LIGHT WEIGHT, PORTABLE BUILDING

BACKGROUND OF THE INVENTION

This invention relates in general to portable buildings and related structures and, more specifically, to a portable building that is prefabricated and easily erected and disassembled.

A great many prefabricated buildings have been designed over the years. Many different fittings have been designed to connect beams, rafters, posts and other components together. Prior systems, however, tend to be complex, heavy and not provide the capabilities of rapid assembly, sturdy construction while in use, and rapid disassembly with convenient component sizes for ease of shipment to a new site.

Many of the prior prefabricated buildings require a number of workers, cranes or other heavy construction equipment and highly trained workers to assemble them. These buildings are not designed for ease of disassembly and shipment to another site for reassembly.

Typical of prior prefabricated building systems is that described by Smith in U.S. Pat. No. 4,342,177. This system uses all steel components. Assembly is very complex, requiring a very large number of differently sized and shaped components. Buildings assembled in this manner are costly to assemble and could not practically be disassembled and reassembled elsewhere.

A portable house is described by Walker in U.S. Pat. No. 797,474 which uses standard lumber and cast metal fittings to connect various wooden components together. A large number of different, heavy, fittings are required. Assembly is complex and would require a number of skilled workers.

Light steel joints for building roof trusses are described by Dufour in U.S. Pat. No. 4,974,387. Fittings for receiving the ends of trusses and holding them at a selected relative angle are described. The metal trusses are welded to the fittings, making the building incapable of being disassembled and reassembled at a different location.

A temporary building for such uses as winter storage of boats is described by Tellberg in U.S. Pat. No. 3,740,084. Corner fittings include casings for receiving the ends of standard lumber and holding them at selected relative angles. The lumber is held in place by short screws and setscrews. The structure is covered with a tarpaulin. While fairly easily assembled and disassembled, the lumber is not solidly secured at the various fitting, so that the structure has little strength and would be subject to damage from high winds, heavy snow loads, etc.

Thus, there is a continuing need for improvements in portable buildings that can be assembled and disassembled quickly by unskilled workers, that use relatively few different components, that can be easily shipped when disassembled, that are lightweight, sturdy and weather resistant and that are variable in appearance and size.

SUMMARY OF THE INVENTION

The above-noted problems, and others, are overcome in accordance with this invention by a portable building system that basically comprises a plurality of ridge receivers that connect the upper ends of rafters to ridge beams, a plurality of hip receivers that connect the lower ends of rafters to hip beams and posts, where the ridge beams, hip beams, rafters and posts make up the building frame. Other specialized receivers may be provided to vary the overall structural design to provide, e.g., for valleys between roof sections, a "lean-to" arrangement, extended roof lines etc. In each case, rafters and posts incorporating bushings cooperating with holes in formed sheet metal receivers are used to provide maximum design versatility.

Only one ridge receiver and one hip receiver configuration are required for a basic building. Structural elements such as beams, rafters and posts can each be identical. The basic structure may be extend indefinitely, adding additional beams and associated structure.

All fasteners are bolts which can be identical and which are easily and quickly installed or removed. The buildings can be rapidly assembled, disassembled and moved. Typically two people can disassemble, move to another location and reassemble a 10 by 12 foot building in less than one hour plus transport time. These buildings are particularly suitable for trade shows, expositions, fairs and the like where the buildings must be regularly moved to new locations and some temporary protection for product security or weather protection is required.

Any suitable covering may be used. Typically, fabrics or other soft coverings such as canvas and plastic tarpaulin material may be used. If desired, solid coverings of corrugated steel, aluminum fiberglass, PVC, etc or flat panels of plywood, pressed board, fiberglass, plastics, aluminum, etc may be used. If heavier coverings are to be used, purlins may be provided between the rafters. Crosspieces may be provided between posts as desired. The walls and roof may be easily insulated with aluminum framed foam core panels placed into space between rafters or posts and held in place with self-drilling screws through the frames.

All of the components can be made from metal sheet material, preferably galvanized steel, although aluminum or other materials could be used, if desired. While any suitable metal thickness may be used, with galvanized steel, 16 gauge is generally effective. With smaller cross section structural elements thinner metal may be used, while with very large structures, a heavier gauge may be preferred. The rafters and posts have a generally tubular cross section. These cross sections are preferably closed tubes, although C-section tubes having a longitudinal opening along one side may be used if desired. The rafters and posts are a slip fit into the receivers with close tolerances, making it possible to put members in place without assistance. Eaves may be flush with the sides or may overhang to any desired extent. The fittings and members are designed to withstand high wind loadings, especially when the posts are secured to the ground. The structure is inherently earthquake resistant. Insulation panels may be inserted into the walls and roof structures and easily fastened in place.

The use of bushings swedged into tubular rafters and posts and locked by compression provide a very rigid, strong, structure giving a diaphragm effect, so that sheer panels on roof or wall surfaces are not required.

BRIEF DESCRIPTION OF THE DRAWING

Details of the invention, and of preferred embodiments thereof, will be further understood upon reference to the drawing, wherein:

FIG. 2 is an exploded perspective view showing assembly of one section of the building of FIG. 1;

FIG. 5 is a section view through a ridge beam, taken on line 5—5 in FIG. 2;

FIG. 6 is a section view through a hip beam, taken on line 6—6 in FIG. 2;

DETAILED DESCRIPTION OF PREFERRED EMBODIMENTS

Figure 1:
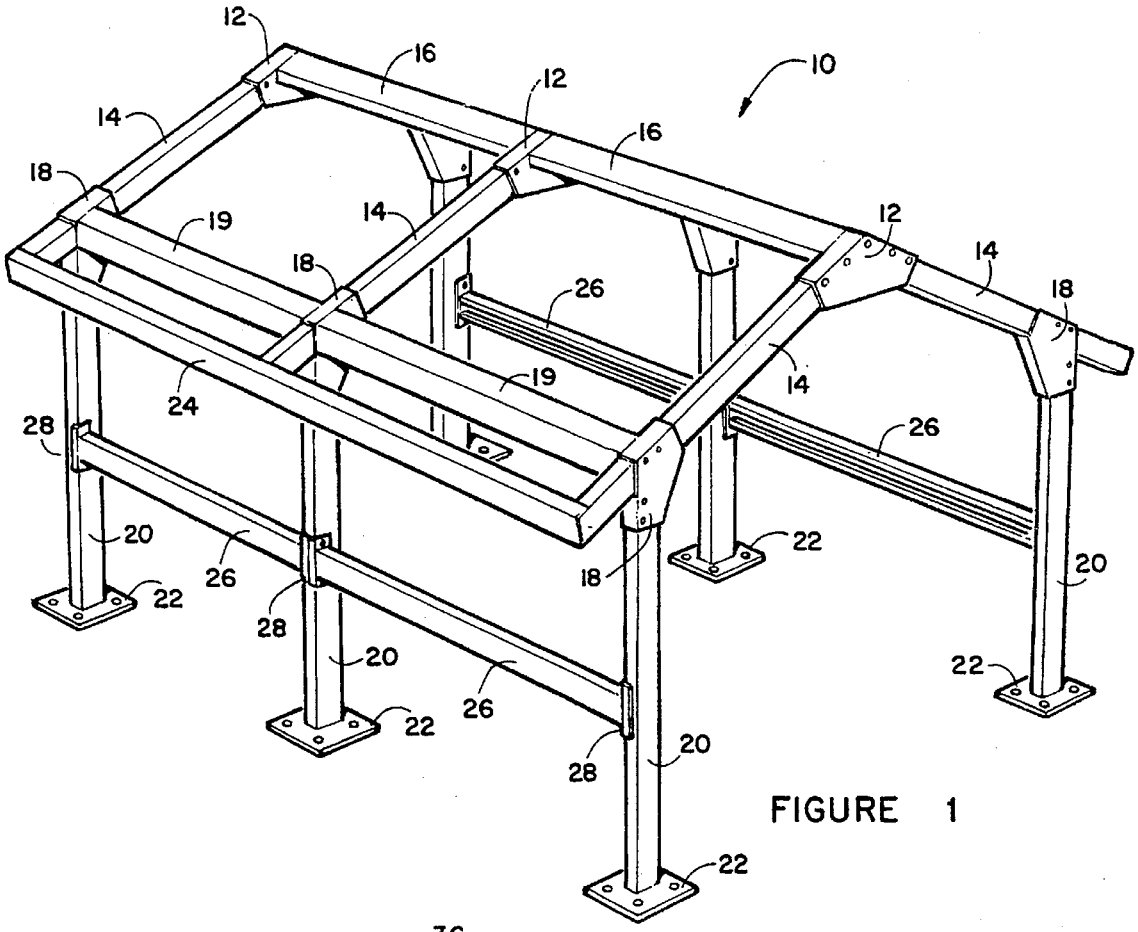
FIG. 1 is a perspective view of a building frame constructed in accordance with the system of this invention.

Referring to FIG. 1, there is seen perspective view of a framed building 10 using the components of this invention. As detailed below, a plurality of ridge receivers 12 each include two angled tubular sleeves which receive the first ends of two rafters 14. Receivers 12 are also secured to the ends of ridge beams 16, as described below.

The second ends of rafters 14 pass through open ended tubular sleeves in hip receivers 18. Rafters 14 extend beyond hip receivers 18 a selected distance and are secured thereto by bolts, as detailed below. The ends of hip beams 19 are secured to the side of hip receiver 18. The top ends of posts 20 fit into closed end sleeves in hip receivers 18 and are secured thereto. Baseplates 22 may be provided at the bottom ends of posts 20 to spread the load and/or may be used to fasten the posts to a foundation or other surface. Posts 20 may telescope, as described below, if desired, so that an irregular foundation surface can be accommodated or so that the height of the building can be varied.

Rafters 14 and posts 20 may have any suitable cross section, such as a tubular section as shown or a C-section.

Fascia members 24 are preferably provided across the ends of rafters 14 to give the eaves a finished look and for connection to any selected roof covering, as detailed below.

Cross pieces 26 may be provided between posts 20 for further strengthening, to provide frames for windows, to support shelves, etc., if desired. Cross pieces 26 are secured to posts 20 by metal angles 68 secured to the ends of the cross pieces by any convenient means, such as welding, and overlap the front side of posts 20 and are secured to the posts in any suitable manner such as by bolts or screws.

Details of the assembly of the beams, posts, rafters and receivers are provided in FIG. 2. Ridge beams 16 have end caps 30 secured to the beams in any suitable manner, such as welding. While end caps 30 could cover the ends of beams 16, preferably they are recessed into the beam ends, flush with those ends. In a particularly preferred embodiment, end caps 30 have narrow flanges 31 that extend slightly into the ends of beams 16 to provide material for spot welding to the sides of the beams ends or the use of rivets or the like to secure the end caps to the beams, as desired. A plurality of holes 32 through an end cap 30 conform to the pattern of holes 34 through ridge receiver 12. A bushing 36 (of the sort shown in FIG. 7) is installed within receiver 12 between the uppermost holes 34 in the spaced walls. The diameter of the bore through that bushing 36 conforms to the diameter of an end cap hole 32, so that receiver 12 can be secured to beam 16 by inserting bolts 38 through bushings in holes 34 and end cap holes 32, then threading conventional nuts (not shown) onto the end of bolts 38. Bushings used in holes 34 at the peak could be simple shouldered bushings with the narrow ends installed in holes 34 and the shoulder against the inside receiver surface adjacent to the holes. The bushings are placed in holes 34 within receiver 12 prior to assembly of the receiver and are held in place by the spaced walls.

Figure 7:
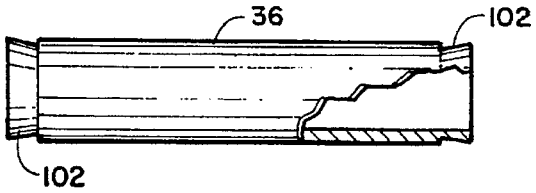
FIG. 7 is a side view, partially cut-away, of a bushing as used within the posts and rafters.

Rafters 14 have similar bushings 36 (as seen in FIG. 7) swedged in holes 40 to match holes 42 in ridge receiver 12 when the rafter is inserted into the receiver. Bolts are inserted through holes 42 and bushings between holes 40 in the spaced walls of rafters 14 to secure the rafters to receivers 12

The second, lower as shown, end of rafter 14 is slid into an open ended sleeve through hip receiver 18. Details of the internal structure of hip receiver 18 are provided in FIG. 4. Holes 46, each of which carries a bushing 36 (not seen) align with holes 48 in hip receiver 18 and at least some of holes 50 in end cap 52 secured to the end of hip beam 19. Again, bolts through the bushings and nuts are installed to hold rafter 14 and hip beam 19 to receiver 18. Generally, holes 46 in rafter 14 are located so that the end of the rafter extends past receiver 18 (as indicated by arrow 54) to create an eave effect. Additional sets of bushings 36 and holes 46 may be provided along rafters 14 so that the rafter extension distance may be varied when the building is used for different purposes.

Post 20 is slid into the lower tubular sleeves of hip receivers 18. Roles 58 in posts 20 contain bushings 36 (not shown) which align with holes 60 in receiver 18. Again, bolts and nuts are installed to secure posts 20 to hip receiver 18. The pattern of bolt holes in ridge receiver 12 and the rafter sleeve of each hip receiver 18 are preferably identical, so that in many cases rafters and posts can be interchangeable.

The above assembly sequence may be performed in any suitable order, since in some cases it Will be preferable to erect the roof first and then install the posts, while in others it may be preferable to install the posts to the hip beams, then assemble the roof.

Figure 3:
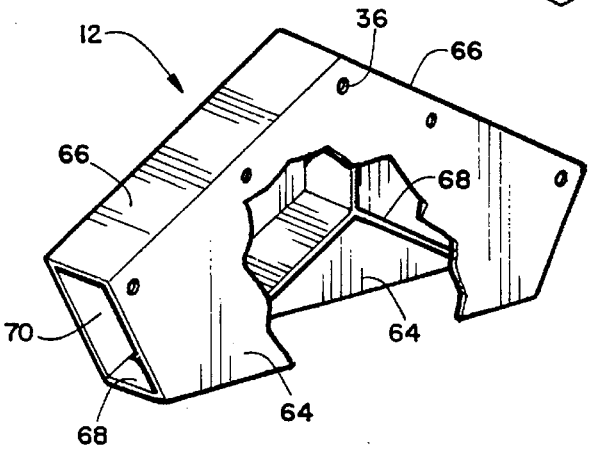
FIG. 3 is a perspective view of a ridge receiver, partially cut away to show internal structure.

Details of the internal structure of ridge receivers 12 are provided in FIG. 3. Two approximately triangular parallel outer walls 64 are provided. Ridge receiver 12 is bounded by edge walls 66 and interior walls 68 which bound tubular sleeves 70. Bushings 36 are positioned as described above to receive bolts for securing ridge beams 16 and rafters 14 to ridge receiver 12. Ridge receiver 12 may be assembled from sheet metal components in any suitable manner. A particularly efficient and economical method is described in conjunction with the description of FIGS. 24–26, below.

Figure 4:
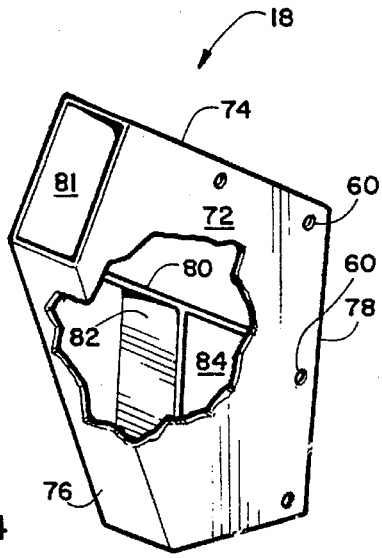
FIG. 4 is a perspective view of a hip receiver, partially cut away to show internal structure.
Figure 26:
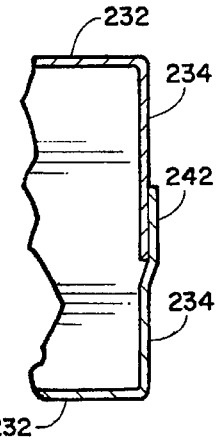
FIG. 26 is a detail view of a rafter receiving opening as seen at 26—26 in FIG. 25.
Figure 24:
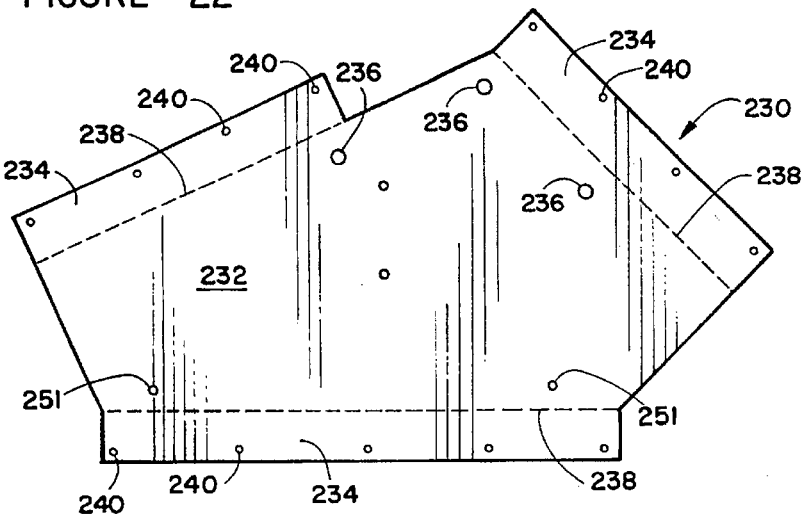
FIG. 24 is a plan view of a preform from which sides of a receiver are formed.
Figure 25:
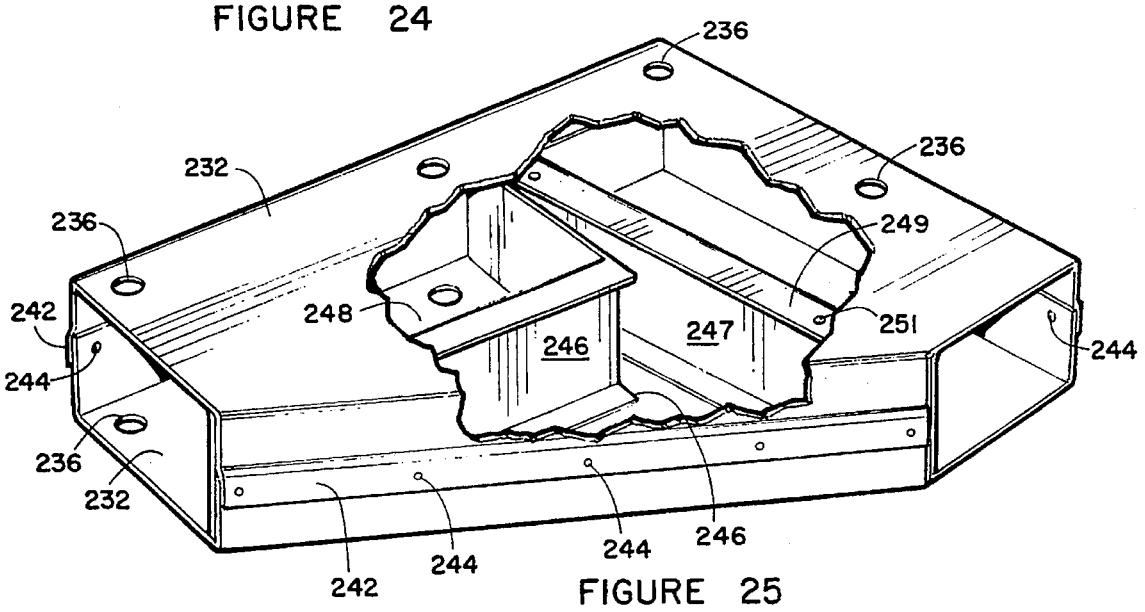
FIG. 25 is a perspective view, partially cut away, illustrating a preferred method of manufacturing the various receivers.

FIG. 4 provides details of the internal structure of hip receiver 18. Two parallel face walls 72 are bounded by outer walls 74. An inner wall 76 forms, with outer wall 74 and portions of the face walls 72, the open ended tubular sleeve 81 that receives a rafter 14. Inner wall 82, together with outer wall 78 and portions of the two face walls 72, form the closed end sleeve 84 for receiving the upper end of post 20. Bushings 36 are provided, as discussed above, to receive bolts securing hip receiver 18 to rafters 14 and post 20. While receiver 18 can be manufactured from selected sheet metal components by any suitable method, the method illustrated in FIGS. 24–26 is preferred.

A preferred cross sectional configuration of ridge beam is provided in FIG. 5. Beam 16 is formed from an elongated metal strip bent to the desired roof angle, typically about 143°, between panel portions 86 and 88. Edge portions 90 and 92 are preferably bent around as shown to form strengthening edges. The underside of ridge beam 16 is open, allowing easy access to the inner surfaces of end caps 30 for installation of nuts on the threaded ends of bolts 38 that project into the beam through holes 32. Alternatively, the bolt heads could be installed within ridge beam 16 with the nuts on the outside surface of ridge receiver 12, to permit easy access for adding on additional structure if desired. While three holes 32 as shown is preferred for an optimum combination of strength and ease of manufacture and assembly, more or fewer bolts may be used, as desired. As seen, in a particularly preferred embodiment, narrow flanges 31 along the edges of cap 30 are bent to fit within the end of beam 16 to provide additional metal to metal interfaces for effective welding, brazing, riveting, etc. to secure the components together.

FIG. 6 shows a preferred cross sectional configuration for hip beams 19. Each hip beam 19 is formed from an elongated metal strip, with the two adjacent faces 94 and 96 typically at an angle of about 108°. Edge portions 98 and 100 are folded over as shown to provide the desired strength and rigidity. This configuration allows excellent access to holes 50 through which the threaded ends of bolts will project so that nuts can be installed conveniently. End cap 52 preferably includes narrow flanges 53 that extend slightly into beam 19 to provide mating material for optimum welding, riveting, etc of the two components together.

Details of bushings 36 as secured within the two receivers, rafters and posts are shown in FIG. 7. Bushings 36 basically comprise a metal tube having an inside diameter corresponding to the outside diameter of the bolts to be used in assembling this structure. For convenience in assembly it is preferred that all bolts used have the same diameter and the same lengths. A groove 102 is machined adjacent to each end of bushing 36. A bushing is slipped through the spaced holes to which the bushing is to be secured, typically holes 40, 42, 48 and 58, with the grooves 102 aligned with the hole edges.

A tapered rod tool, such as a conventional drift pin, may forced into each end of the bushing bore to expand the bore ends, so that grooves 102 tightly engage the hole edges. In the field, it is preferred that the tapered rod tool press the tapered surfaces into the bushing simultaneously from both sides. Typically, one tapered rod could have a threaded bore therethrough, with a threaded stud at the end of the other rod threaded thereinto to force the two rods together.

This method both locks the bushing to the hole and slightly expands the bore adjacent to the bushing ends, making insertion of bolts into the bushings easier and allowing accommodation of slight misalignment between rafter or post bushing and a receiver hole.

Figure 8:
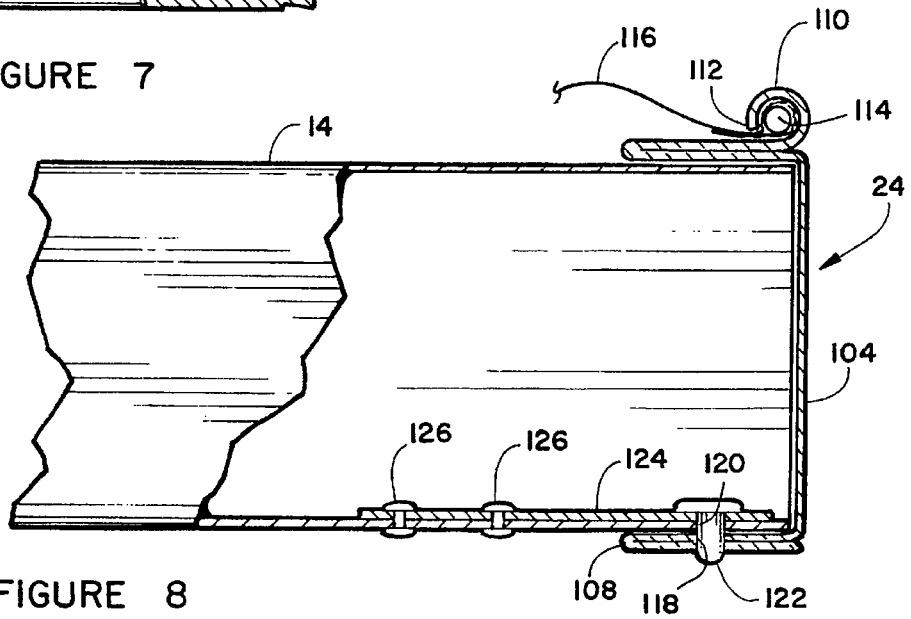
FIG. 8 is a detail view of a portion of an eve end, partially cut-away.
Figure 21:
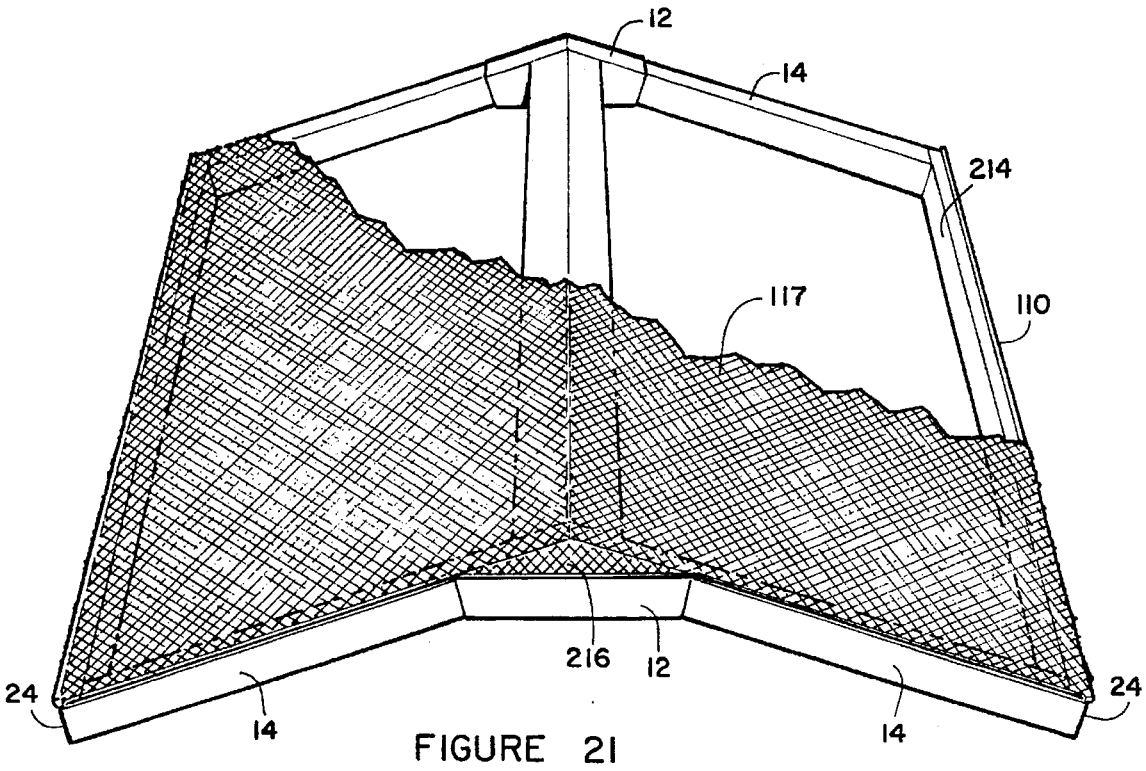
FIG. 21 is a perspective view of a flexible roof covering embodiment.

FIG. 8 shows a portion of the eave end of a rafter 14 with a fascia member 24 in place at the rafter end. Fascia member 24 is an elongated metal strip preferably roll formed into the cross sectional configuration shown. If desired, the fascia member could be made up of several strips secured together in any suitable manner, such as riveting, soldering, welding, etc. The center portion 104 of the strip covers the ends of rafters 14, with edges 106 and 108 folded over the upper and lower rafter end surfaces. The center portion 104 has a width substantially equal to the depth of rafter 14. The upper edge 106 includes a bead tube 110 having an opening slot 112. Where flexible material, such as plastic sheet, canvas, or the like is to cover the roof portion of the structure, an elongated generally cylindrical bead 114 (typically a rope of suitable diameter) is sewn into a narrow hem 116 along opposite edges of cover 117, so that those beads can be slipped into one end of each tube 110 on opposite sides of the roof, with the cover material extending through slot 112. The cover is thus moved across the roof as the beads move into tubes 110, so that the cover is uniformly held in place while allowing rapid disassembly. A particularly preferred cover arrangement is shown in FIG. 21, as described below.

Figure 9:
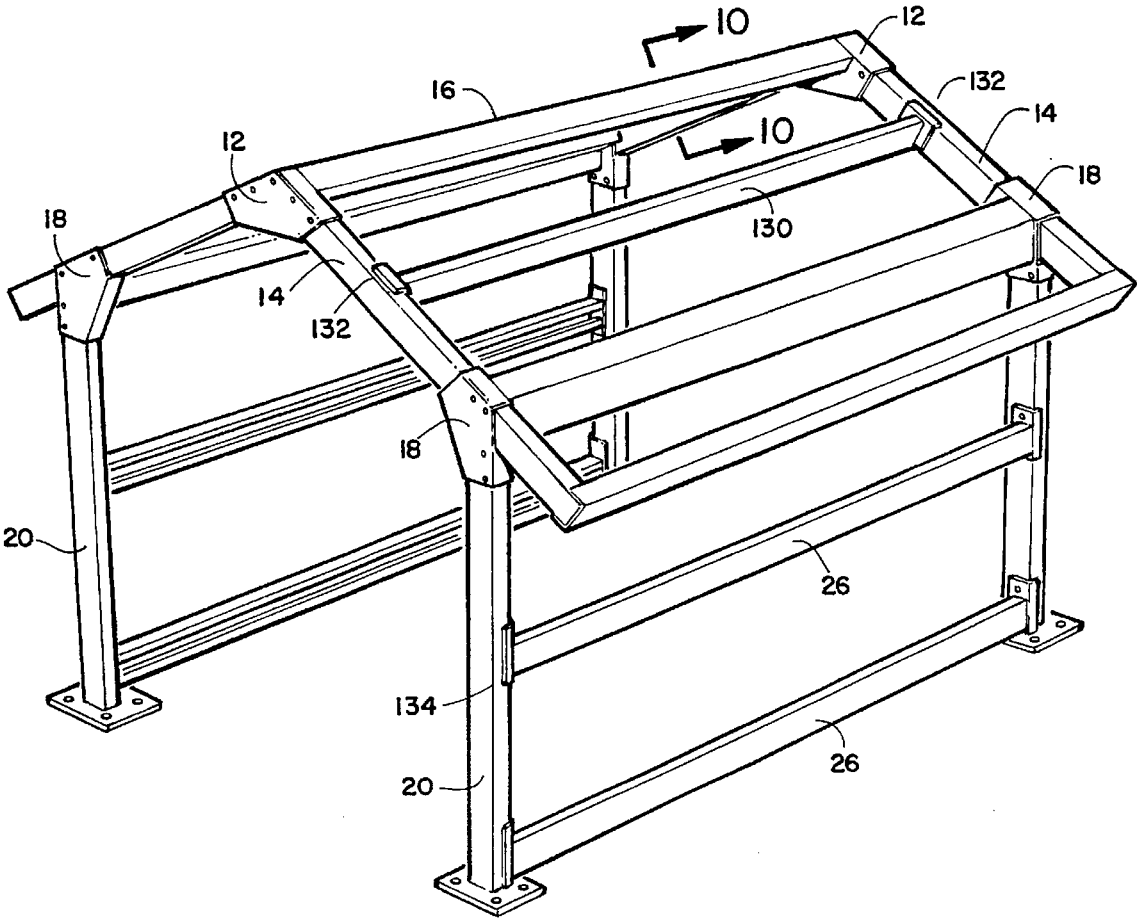
FIG. 9 is a perspective view of a building showing how purlins and wall crosspieces may be used.

Edge 108 of fascia member 24 has a hole 118 aligned with a hole 120 each rafter 14. A pin 122 is mounted on a flat spring 124 fastened to rafter 14 by rivets 126. Pin 122 is urged by spring 124 toward the position extending through holes 118 and 120 to releasably lock fascia member 24 to rafter 14. Thus, the fascia member can very quickly and easily be installed and removed, but is held tightly in place once installed.

Where heavier roof covering such as plywood is used than fabric or light corrugated materials, it may be desired to install purlins at suitable roof locations. FIG. 9 illustrates an arrangement for attaching purlins 130 between rafters 14 where needed. Each purlin 130 is a tubular or C-section metal beam having a metal angle piece 132 secured to each end, such as by welding. The angle piece extends up and over the top of a rafter 14 and is secured thereto by any suitable means, such as self-drilling screws or the like.

While this would usually be a somewhat more permanent structure, with the addition of heavier roofing material, still, purlins 130 could be removed very rapidly when the building is to be disassembled.

Figure 10:
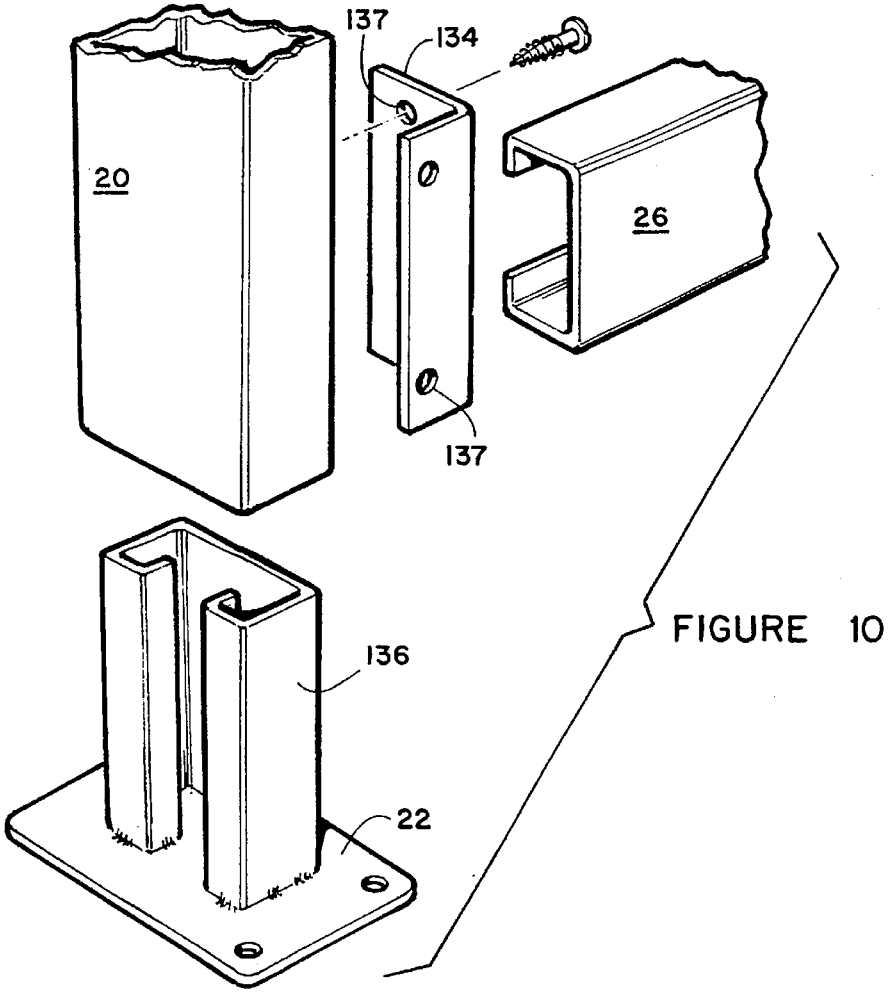
FIG. 10 is a perspective view of a telescoping post embodiment.

FIG. 9 also illustrates the use of two crosspieces 26 in each wall. The end fitting 28 as shown in FIG. 1 is basically a metal angle, with each leg having a width equal to the width of crosspiece 26. While fitting 28 can be fastened to crosspiece 26 in any suitable manner, welding is preferred for strength and ease of manufacture. If desired for greater strength, as seen in FIGS. 9 and 10, an angle piece 134 having a width greater than the crosspiece width may be used, to allow use of fasteners, such as screws or bolts, through the angle piece holes 137 on two adjacent sides of post 20.

In some cases, it is desirable to have a variable roof height in a portable building or to accommodate an irregular foundation. FIG. 10 illustrates a telescoping system in which post 20 telescopes over an inner member 136 which is fastened to baseplate 22. Post 20 can be elevated to the desired height and the post secured to inner member 136 by the same fasteners 138, bolts, screws or the like, which holds angle piece 134 and crosspiece 26 to post 20. Of course, additional screws could be used through another side of post 20 for greater strength, if desired. If desired a longer inner member 136 could be used without a baseplate 22. Then, the inner member could be inserted into a correspondingly sized hole (not shown) in a concrete foundation or the like to provide an exceptionally strong structure, highly resistant to winds and the like.

Figure 11:
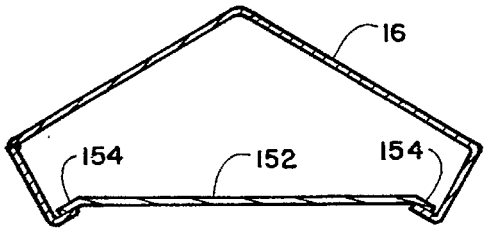
FIG. 11 is a transverse section view of a cap assembly for the open side of a beam.

In order to provide a more finished appearance to the interior side of ridge beams 16 and hip beams 19 and increase beam resistance to twisting, an elongated cover sheet 148 as seen in section in FIG. 11 may be provided. End walls 150 with folded edges are formed on sheet 148 to clip over the edges of the corresponding beam. The length of walls 150 can be varied as desired. While cover 148 is shown in conjunction with beam 16, the same configuration may be used with beam 19, sized to match. The sides of cover 148 may be sized to match the thickness of insulation panels inserted into the space between rafters 14, ridge beam 16 and hip beam 19, as described above.

Figure 12:
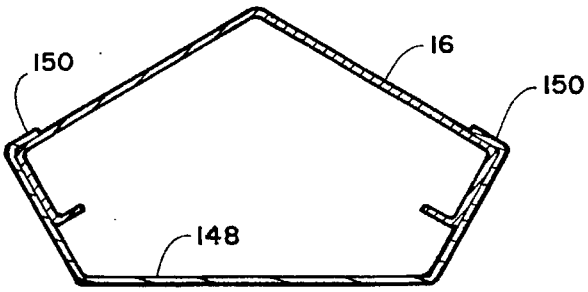
FIG. 12 is a transverse section view of an alternate cap assembly for the open side of a beam.

Alternately, as seen in FIG. 12, an inside cover sheet 152 may be provided within either ridge beam 16 or hip beam 19. Slightly bent edges 154 may be provided to conform to the corresponding surfaces of the beams. While sheet 152 may be simply held in place by gravity, if desired sheet metal screws or the like may be used to hold cover 152 in place.

Figure 13:
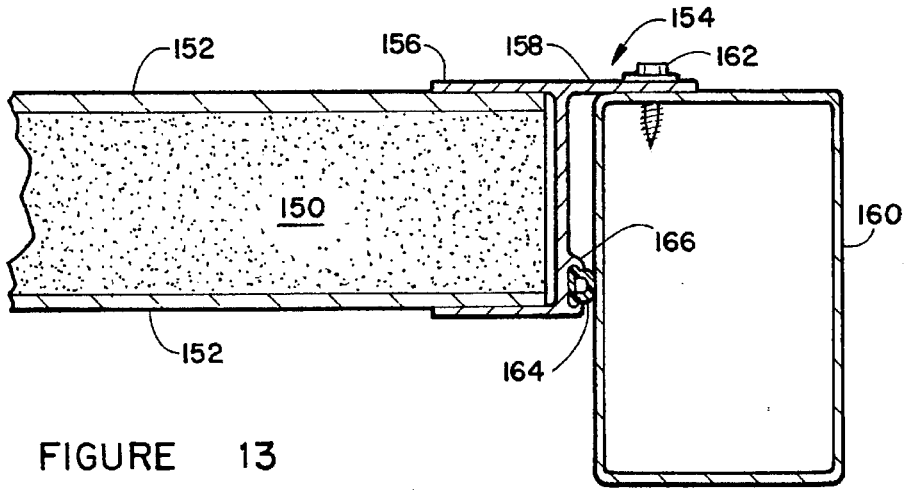
FIG. 13 is a transverse section through an insulation panel edge, showing the means for attachment to building structure.

If desired, insulation panels may be inserted in the roof and walls of the building. FIG. 13 illustrates a preferred insulation panel configuration. A suitable insulation panel is prepared and sized to fit between beams and rafters, between pulins and rafters, between posts, etc. A preferred panel comprises foam core 150 with facings 152. Any suitable foam may be used such as closed cell styrene, urethane, polyamides and the like. Facings preferably are a decorative, dent resistant material such as aluminum, acrylic or vinyl sheet, hardboard, plywood paneling, etc.

An extrusion or otherwise formed bracket 154 includes a channel section 156 sized to fit the thickness of foam panel 150. While in many cases channel section 156 need not be fastened to panel 150, if desired screws, glue or the like may be used. A flange 158 is sized to fit over a building structures member such as a rafter 14, purlin 21 or post 20 and be secured thereto by any suitable fastener, such as self-tapping screws 162. Preferably, a bulb seal 164, such as neoprene, is installed in a small channel 166 to seal the gap between structural member 160 and bracket 154 as a vapor barrier and for most effective insulation.

While ridge receivers 12 and hip receivers 18, together with standard beams, rafters and posts will accommodate most requirements for portable buildings, the system of this invention allows the variation and modification of the receivers to allow a great many different building configurations.

Figure 15:
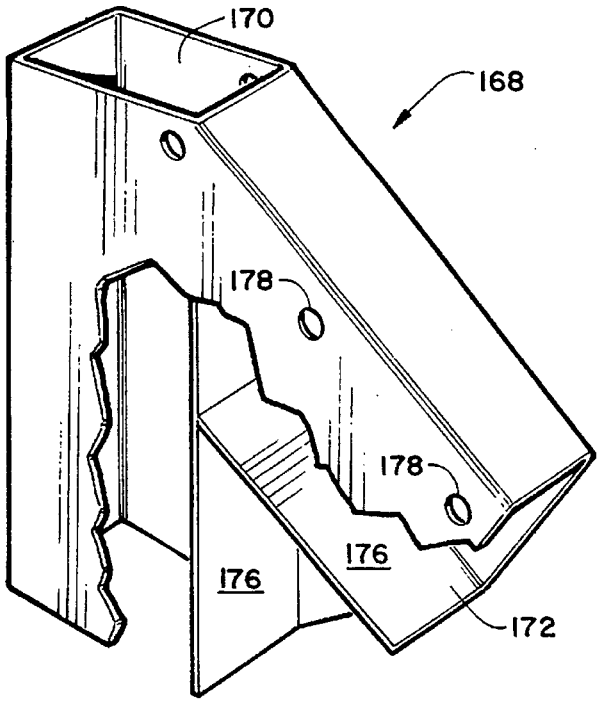
FIG. 15 is a perspective view, partially cut-away, showing a receiver for use with the mid-post building extension of FIG. 14.
Figure 14:
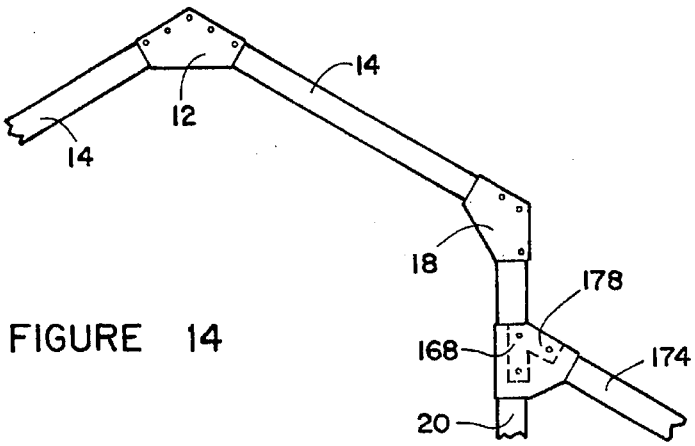
FIG. 14 is a detail elevation view of a building showing a mid-post building extension embodiment.

In some cases, a building extension is desirable with a side room connected at mid post, as shown in FIG. 14. Here the basic structure is unchanged, comprising ridge receivers 12, rafters 14 hip receivers 18, posts 20 and associated beams. A mid-post receiver 168 is provided as seen in FIGS. 14 and 15 having a vertical sleeve 170 sized to slip over a post 20 and a side rafter sleeve 172 sized and positioned to receive an end of a side rafter 174, generally identical to a rafter 14, but of selected length. Walls 176 within mid-post receiver 168 define sleeves 170 and 172. Suitable holes 178 are provide to match holes and bushings in beams and rafters, in the manner detailed above.

Figure 16:
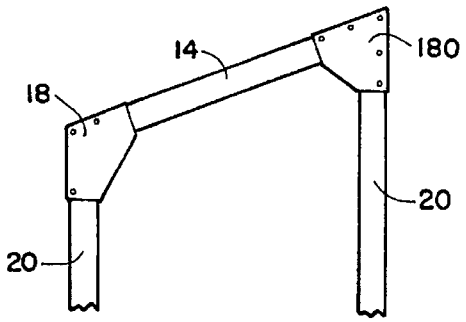
FIG. 16 is a detail elevation view of a building showing an optional "lean-to" building configuration.
Figure 17:
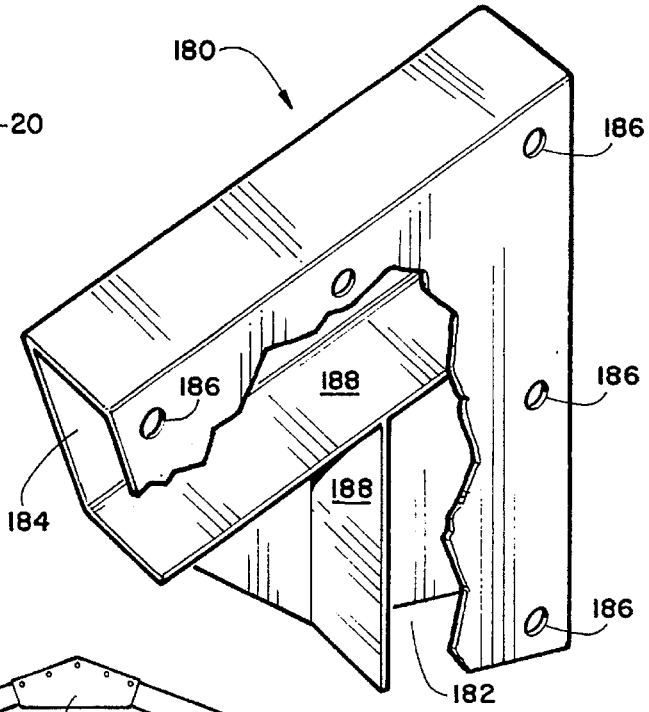
FIG. 17 is a perspective view, partially cut-away, showing a receiver for use with the "lean-to" building embodiment of FIG. 16.

Another variation, where a shed roof building is desired, is illustrated in FIGS. 16 and 17. Here, posts 20 (of selected length, hip receiver 18 and rafters 14 are the same as described above. A lean-to receiver 180 includes a vertical sleeve 182 sized to receive the top end of post 20 and an angled sleeve 182 sized to receive an end of a rafter 14. A plurality of holes 1186 are located to match the locations of holes and bushings in the post and rafter ends. Walls 188 define the size and configuration of sleeves 180 and 182.

Figure 18:
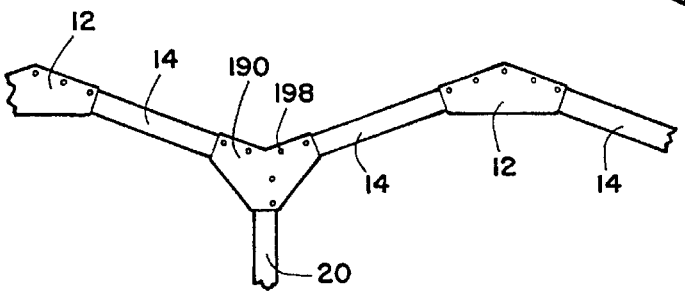
FIG. 18 is a detail elevation view of a building showing a roof valley embodiment.
Figure 19:
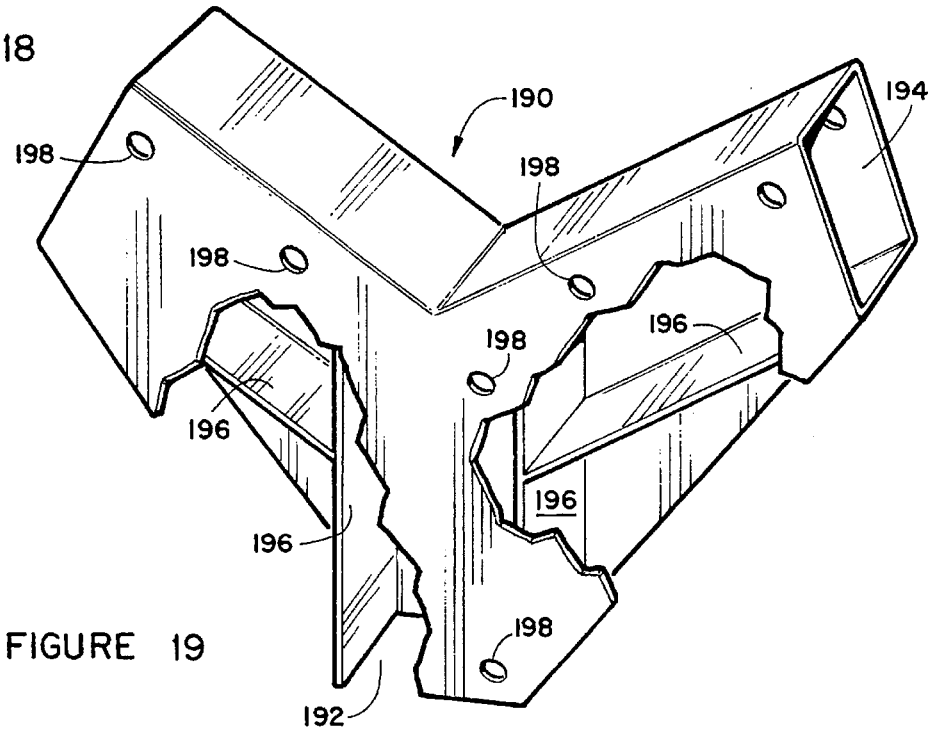
FIG. 19 is a perspective view, partially cut-away, showing a receiver for use with the valley roof embodiment of FIG. 16.

FIGS. 18 and 19 illustrate another building configuration where contiguous buildings are joined with valleys between adjacent roofs. Here, ridge receivers 12, rafters 14, hip receivers 18, posts 20 and the various beams are the same as describe above. Valley receivers 190 include a vertical sleeve 192 for receiving ends of posts 20 and two opposite angled sleeves 194 for receiving ends of rafters 14. Walls 196 define sleeves 192 and 194. A plurality of holes 198 are located to cooperate with corresponding holes and bushings in posts 20 and rafters 14.

Figure 20:
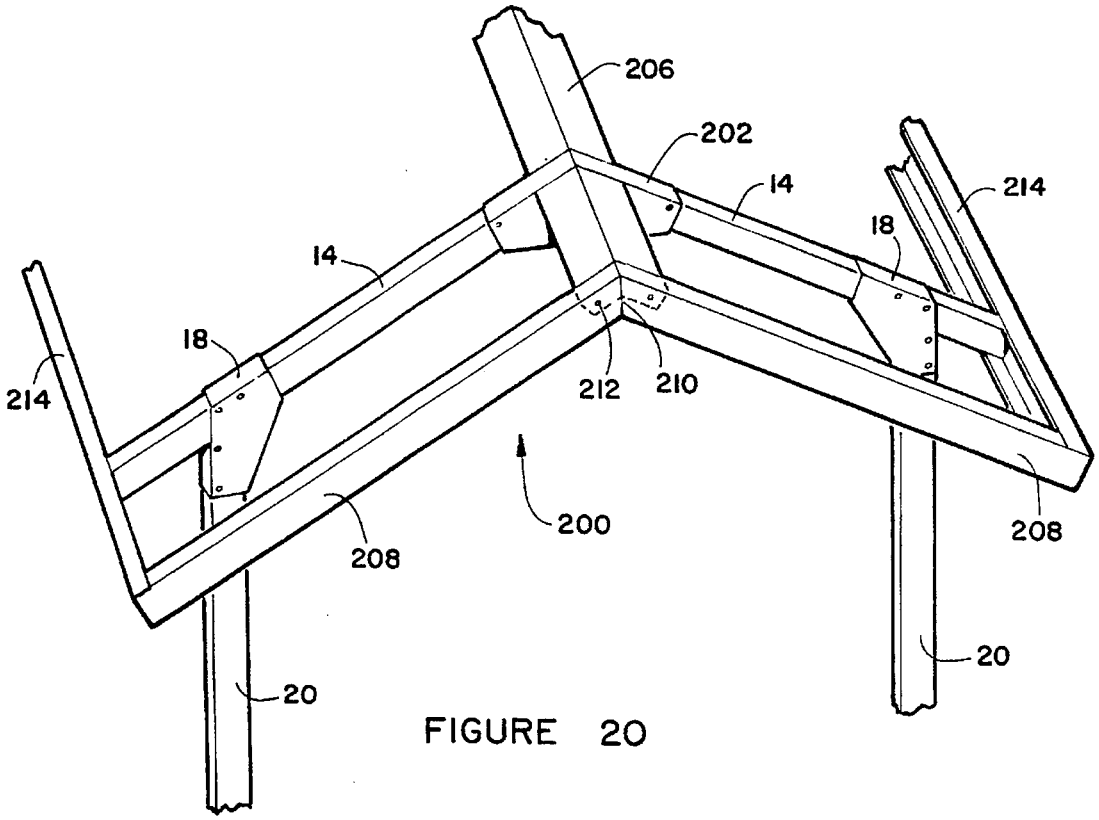
FIG. 20 is a perspective view of a roof gable extension embodiment.

FIG. 20 illustrates an alternate embodiment which provides extending gables 200. Here most roof rafters 14, hip receivers 18 and posts 20 are the same as described above. Ridge receiver 202 includes a transverse opening 204 through which an extended end of ridge beam 206 extends. Ridge beam 206 is basically identical with ridge beam 12 described above, only longer. The transverse opening through ridge receiver 202 can be bounded by side walls (not shown) of the sort described above as bounding sleeves. Receiver 202 can be fastened to ridge beam 206 in any suitable manner, such as with self-drilling screws, spot welding, etc.

End fascia members 208 have ends 210 cut to match. Holes 212 in rafters 208 as described above and match holes in the ridge beam end caps, as described above. Fascia strips 214 are extended to meet the lower ends of end fascia strips 208 and are fastened thereto by screws 215 through the overlapping flanges.

Figure 22:
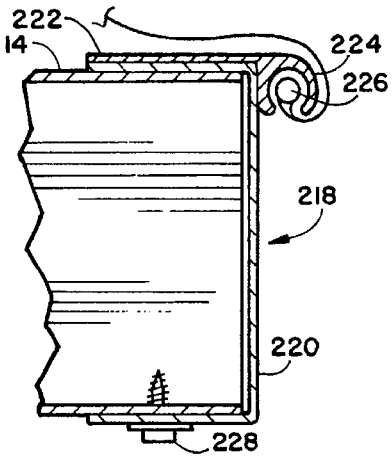
FIG. 22 is a second embodiment of the fascia strip and cover retainer as seen in FIG. 8.
Figure 23:
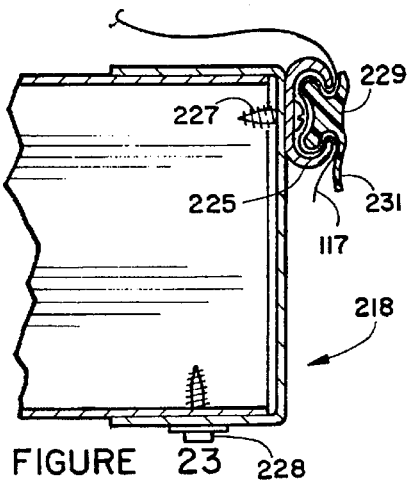
FIG. 23 is a third embodiment of the fascia strip and cover retainer as seen in FIG. 8.

A preferred roof covering is illustrated in FIG. 21. The material is any suitable flexible material, such as canvas or plastic sheeting, which may be transparent or translucent, if desired. Typically, beads 114 in hems 116 along the side edges of cover 117 of the sort shown in FIG. 8 or 22 are inserted into tubes 110 of fascia strips 24 before the fascia strips are installed on the ends of rafters 14. Cover 117 is then placed over the roof, with pockets 216 over the ends of ridge receivers 12, then fascia strips are installed as shown in either FIG. 8 or 22. This assures a tight covering over the roof and pockets 216 prevent movement lengthwise of the roof.

An alternate fascia strip and roof covering retainer is shown in FIG. 22. Here fascia strip 218 comprise a channel section 220 sized to fit over the ends of rafters 14 having an extrusion 222 which includes a flat strip fastened to channel 218 such as by rivets (not shown) and having an outwardly and downwardly extending tube and slot 222 for receiving a cover bead 226 of the sort shown in FIG. 8. With this arrangement, rain, snow and dirt will not accumulate within tube 224. During installation, channel is pivoted into place about the upper web until the lower web moves into place. Then screws of other fasteners 228 are installed into the ends of rafters 14. This pivoting method stretches the cover slightly, assuring a tight fit.

A third alternate means for securing cover 117 to a fascia strip 218. An extruded channel 225 is secured to fascia strip 218 by screws 227. A bifurcated extrusion 229 "snaps" into channel 227 with the edged of a cover 117 therebetween. Handle strip 231 along extrusion aids in forcing the extrusion bifurcated projections into channel 227 and in pulling the extrusion projections out of the channel when the cover is to be removed.

A preferred method of manufacturing receivers of the sort used in the portable buildings of this invention is illustrated in FIGS. 24–27.

FIG. 24 shows a plan view of a sheet metal preform 230 from which each of the halves of the exterior of a receiver are formed. For the purposes of illustration, a typical hip receiver 188 is illustrated, although all of the receiver variants are manufactured by the same basic method. Preform 230 may be cut from sheet metal by any suitable method. For optimum efficiency and precision, punching is preferred. The face wall portion 232, sidewall portions 234 and assembly holes 236 in a selected pattern are preferably all punched at the same time. Where the preforms are to be riveted together, rivet holes 240 are also punched at the same time. Sidewall portions 234 are then bent to about 90° generality along broken lines 238. In order to make one receiver, two preforms 230 are provided with sidewalls 234 bent in opposite directions.

As seen in FIG. 26, the edge of sidewalls 234 on one preform are preferably given a jog bend 242 so that the inner wall is flat and the overlapping portions are parallel. Double flush rivets 244 are emplaced in a conventional manner. Alternatively, spot welds or other suitable fastening means may be used in place of rivets 244.

After the outerwalls have been assembled and fastened, inner sleeve walls 246, each having a narrow flange 248, are inserted and block gauges are inserted to assure that the sleeves have the proper widths, after which flanges 248 are fastened to face walls 232 by rivets, spot welding or the like. Stainless steel blind structural flush rivets are preferred. The gauge blocks are removed and the receiver is ready for use.

Figure 28:
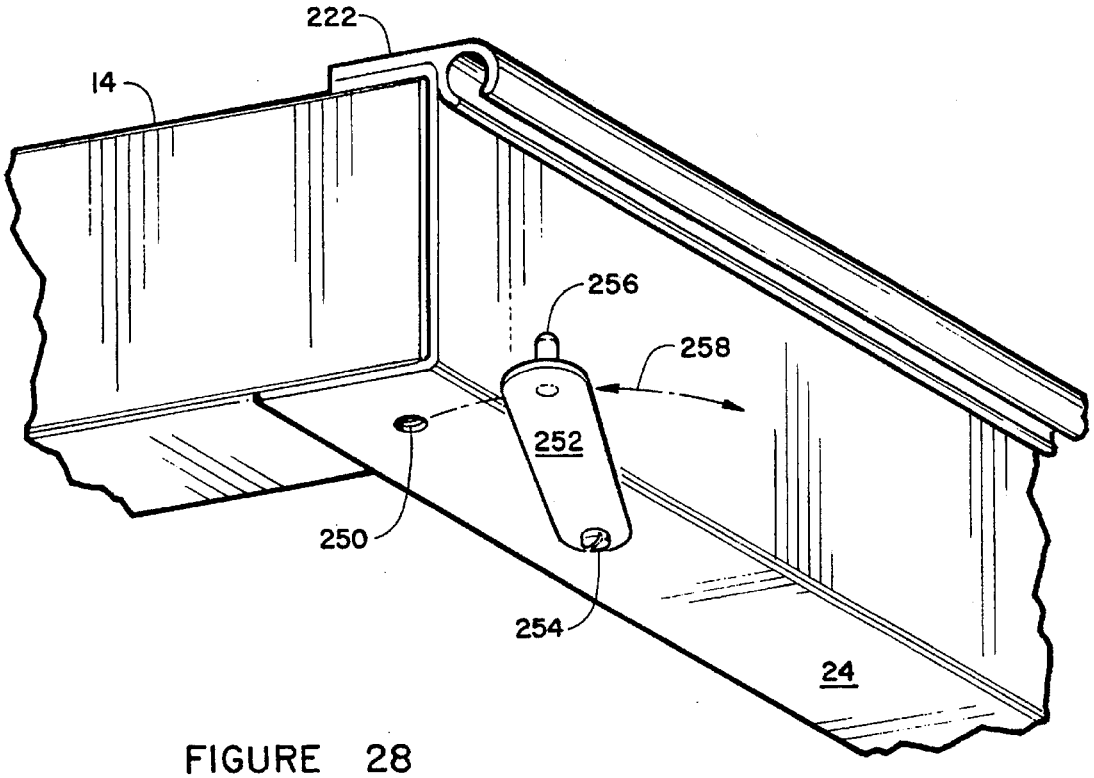
FIG. 28 is a perspective view looking upwardly at another embodiment of the device for securing a facia strip; to rafter ends.
Figure 27:
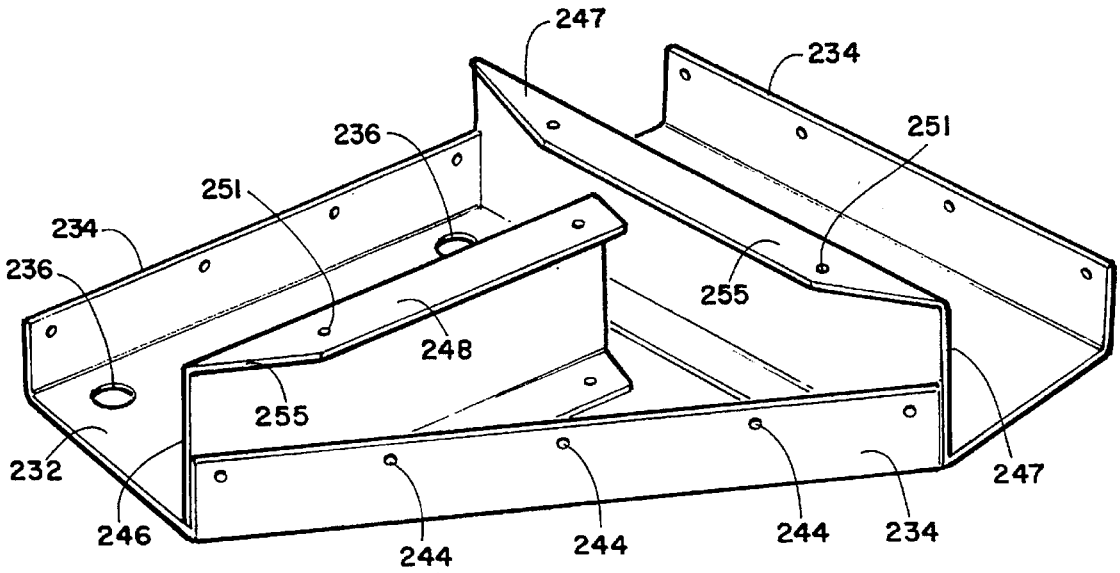
FIG. 27 is a detail perspective view of the receiver of FIG. 25 with the upper wall removed.

Another embodiment of the mechanism for securing a fascia member 24 to the ends of rafters 14 is shown in FIG. 28. A channel section 220 for retaining a cover is included, as discussed in conjunction with FIG. 22. In this case, aligned holes 250 are provided through fascia member 24 and rafter 14. A spring band 252 is mounted by a suitable bolt or rivet 254, typically a machine screw and ESNA nut, which permits band 252 to swivel. Typically, band 252 is formed from a hard stainless steel spring material. An upstanding short, round-head, pin 256 sized to fit in holes 250 is mounted on band 252. In use, band is in the position shown in solid lines as fascia member 24 is fitted over rafters 14. Once holes 250 are aligned, band 252 is bent to allow the end of pin 256 to move over the lower surface of fascia member 24 and snap into holes 250 to hold the fascia in place, as indicated by arrow 258 and as shown in broken lines. When the building is to be disassembled, bands are against bent to remove pins 256 from holes 250 and rotate to the solid line position, where the pin is out of the way to allow easy removal of fascia member 24.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A portable building assembly comprising:

a plurality of rafters;

a plurality of ridge receivers, each having two spaced, substantially parallel, ridge walls, two relatively angled tubular sleeves between said ridge walls receiving first ends of two of said rafters, and means securing said rafter first ends within said ridge receiver sleeves;

plurality of posts;

a plurality of hip receivers, each having two spaced generally parallel hip walls, an open ended sleeve between said hip walls receiving a second end of one of said rafters with said rafter extending through said sleeve a selected distance and a closed end sleeve between said hip walls receiving an end of a post, and means securing said rafter second end and said post end within said hip receiver sleeves;

a plurality of elongated ridge beams;

means fastening ends of said ridge beams to said ridge receiver walls;

a plurality of elongated hip beams;

means fastening ends of said hip beams to said hip receiver walls;

said plurality of posts being generally tubular and having first ends fitting within said hip receiver closed sleeves and having means cooperating with said hip receiver post securing means to secure said posts to said hip receivers; and at least some of said ridge beams and said hip beams having an elongated opening along one side and further including an elongated cover secured to at least some of said ridge beams and said hip beams covering at least some of said elongated openings.

2. The portable building assembly according to claim 1 wherein said means securing said rafter first and second ends within a ridge receiver sleeve and a hip receiver sleeve comprises a plurality of holes having a diameter and being in said rafter and a plurality of holes in said ridge and hip receivers, said holes oriented to align when said rafter is emplaced in said ridge and hip receiver sleeves, a plurality of bushings fixed within said rafter and aligned with said rafter holes, said bushings being tubular with a selected inside diameter, said inside diameter of said bushings being substantially equal to said diameter of said ridge and hip receiver holes, whereby bolts may be inserted through said bushings and corresponding hip and ridge receiver holes to secure said rafter in place.

3. The portable building assembly according to claim 1 wherein said means securing said post within said post end receiving hip receiver sleeve comprises a plurality of holes in said post and a plurality of holes in said post end sleeve, said holes having a diameter and being oriented to align when said post end is inserted in said post end sleeve, a plurality of bushings fixed within said post and aligned with said post holes, said bushings being tubular with a selected inside diameter, said inside diameter of said bushings being substantially equal to the diameter of said post end sleeve holes, whereby bolts may be inserted through said bushings and corresponding post end sleeve to secure said post in place.

4. The portable building assembly according to claim 1 wherein said means securing a ridge beam to said ridge receiver walls comprises a ridge beam end cap secured to an end of a ridge beam, a plurality of aligned holes in said ridge walls, a plurality of holes in said ridge beam end cap, said holes having a diameter and being oriented to align with said ridge beam end cap holes when said ridge beam end cap is in place in contact with a ridge beam wall, a plurality of tubular bushings, each having a selected inside diameter, within said ridge receiver fixed between said ridge wall holes, said inside diameter of said bushings being substantially equal to the diameter of said end cap holes, whereby bolts may be inserted through said bushings and corresponding end cap to secure said ridge beam to said ridge receiver.

5. The portable building assembly according to claim 1 wherein said means securing a hip beam to said hip walls comprises a hip beam end cap secured to an end of a hip beam, a plurality of aligned holes in said hip walls, a plurality of holes having a diameter and being in said hip beam end cap, said holes oriented to align with said hip wall holes when said hip beam end cap is in place in contact with a hip wall, a plurality of tubular bushings, each having a selected inside diameter, within said hip receiver, fixed between said hip wall holes, said inside diameter of said bushings being substantially equal to the diameter of said end cap holes, whereby bolts may be inserted through said bushings and corresponding end cap to secure said ridge beam to said ridge receiver.

6. The portable building assembly according to claim 1 wherein at least some of said generally tubular posts and said rafters have a closed rectangular cross section.

7. The portable building assembly according to claim 1 wherein at least some of said generally tubular posts and said rafters have a generally C-shaped cross section.

8. The portable building assembly according to claim 1 further including at least one purlin having a first flange of a metal angle piece secured to each end and a second flange extending away from said end, so that said second flanges can be fastened to adjacent rafters to reinforce said rafters.

9. The portable building assembly according to claim 1 further including at least one cross piece having a first flange of a metal angle piece secured to each end, and a second flange extending away from said end, so that said second flanges can be secured to adjacent posts.

10. The portable building assembly according to claim 1 wherein second ends of said posts further include generally C-shaped members telescoped into said posts and means securing said C-shaped members to said posts, whereby overall height of said posts and C-shaped members can be varied.

* * * * *